US010264838B2

(12) United States Patent
Quiroz et al.

(10) Patent No.: US 10,264,838 B2
(45) Date of Patent: Apr. 23, 2019

(54) BASEBALL CAP WITH A COMB ON THE STRAP

(71) Applicant: Otto International, Inc., Fairburn, GA (US)

(72) Inventors: Anthony Quiroz, Huntington Beach, CA (US); Joseph Koslik, Corona, CA (US); Razgo Lee, Ontario, CA (US)

(73) Assignee: OTTO INTERNATIONAL, INC., Fairburn, GA (US)

( * ) Notice: Subject to any disclaimer, the term of this patent is extended or adjusted under 35 U.S.C. 154(b) by 101 days.

(21) Appl. No.: 14/999,412

(22) Filed: May 3, 2016

(65) Prior Publication Data

US 2017/0318886 A1 Nov. 9, 2017

(51) Int. Cl.
*A42B 1/24* (2006.01)
*A42B 1/02* (2006.01)

(52) U.S. Cl.
CPC . *A42B 1/24* (2013.01); *A42B 1/02* (2013.01)

(58) Field of Classification Search
CPC .. A42B 1/24; A42B 1/02; A42B 1/004; A42B 1/04; A42B 1/22; A42B 1/248; A42B 1/20
See application file for complete search history.

(56) References Cited

U.S. PATENT DOCUMENTS 684,945 A * 10/1901 McCulloch ..... A42B 7/00 132/130
2,651,310 A * 9/1953 Selson ..... A41G 5/0093 132/274
5,533,213 A * 7/1996 Reiner ..... A42B 1/248 2/195.2
5,657,491 A * 8/1997 Young ..... A42B 1/061 2/195.2
5,664,261 A * 9/1997 Lacy ..... A42B 1/062 2/172
5,740,557 A * 4/1998 Reid ..... A42B 1/248 2/195.1
5,887,289 A * 3/1999 Theoret ..... A42B 1/08 2/195.1
6,131,249 A * 10/2000 Suenaga ..... A42B 1/22 24/168
6,857,134 B1 * 2/2005 Cowell ..... A42C 5/04 2/209.13
6,941,581 B1 * 9/2005 England ..... A42B 1/22 2/195.2
2002/0108165 A1 * 8/2002 Porter ..... A42B 1/22 2/195.2

(Continued)

*Primary Examiner* — Khaled Annis
(74) *Attorney, Agent, or Firm* — Platinum Intellectual Property LLP

(57) ABSTRACT

A baseball cap includes a surfing wax comb attached to the main strap of the baseball cap. The surfing wax comb is instantly attachable and detachable from the strap. The strap comprises two sectional straps. Each of the two straps can go through a hole on the comb forming a loop reattached back to the root of the strap. Each of the two straps can comprises a female structure on the inner side of the strap, such that any portion of the inner side of the strap can be selected attached to a male structure on the sweat band. The baseball cap can comprise a decorative strip between the front panel and the visor. An accessory carrying structure is also disclosed herein, which is able to be used on a hat and a bag.

9 Claims, 9 Drawing Sheets

(56) References Cited

U.S. PATENT DOCUMENTS

| | | | | |
|---|---|---|---|---|
| 2003/0233696 | A1* | 12/2003 | Lee | A42B 1/22 2/195.2 |
| 2004/0045075 | A1* | 3/2004 | Yan | A42C 5/00 2/183 |
| 2004/0187191 | A1* | 9/2004 | Lee | A42B 1/24 2/171 |
| 2006/0174398 | A1* | 8/2006 | Proctor | A42B 1/062 2/209.13 |
| 2006/0225185 | A1* | 10/2006 | Kronenberger | A42C 5/00 2/195.2 |
| 2008/0052805 | A1* | 3/2008 | Syphrit | A42B 1/22 2/183 |
| 2013/0318688 | A1* | 12/2013 | Cherin | A42B 1/02 2/209.13 |
| 2014/0053319 | A1* | 2/2014 | Cho | A42B 1/248 2/209.13 |
| 2016/0021962 | A1* | 1/2016 | Lacy | A42B 1/201 2/181 |

* cited by examiner

400

BASEBALL CAP WITH A COMB ON THE STRAP

FIELD OF INVENTION

The present invention relates to baseball caps. Specifically, the present invention relates to functional units on the strap of the baseball caps.

BACKGROUND OF THE INVENTION

Typically, a baseball cap comprises a strap having an elongated plastic or cloth piece with a sole function for adjusting the size of the cap to fit different head sizes of users.

SUMMARY OF THE INVENTION

A baseball cap comprises a bill, one or more panels, and a strap. A functional unit is coupled with the strap. In some embodiments, the strap is an adjustable strap. In some embodiments, the functional unit comprises a surf wax comb, a hair comb, a scraper, or a combination thereof.

In an aspect, a cap comprises a body of the cap, a strap having an extendable structure for adjusting a size of the cap, wherein the strap comprises a first elongate member and a second elongated member, and a connecting member couples with the first elongate member and the second elongated member. In some embodiments, the connecting member comprises a first opening and a second opening. In other embodiments, the first elongate member goes through the first opening forming a first loop. In some other embodiments, the first elongate member comprises a female structure attachable to a male structure at an end of the first elongated member. In some embodiments, the male structure comprise a structure having a specific engaging force with the female structure. In other embodiments, the connecting member comprises a rigid polymeric object. In some other embodiments, the connecting member comprises a surfing wax comb. In some embodiments, the connecting member comprises a container.

In another aspect, a baseball cap comprises one or more panels forming a body of the baseball cap, a strap having a first connecting member and a second connecting member, and a comb connecting the first connecting member and the second connecting member forming a closed circle for fitting a head of a user. In some embodiments, the body comprises a rope between the body and a visor. In other embodiments, the body comprises a logo at a front panel of the body. In some other embodiments, the body comprises one or more mesh structures. In some embodiments, the body comprises a front panel having a solid structure.

In another aspect, a method of manufacturing a baseball cap comprises forming a body by joining a plurality of panels, forming a strap near a bottom portion of the body, wherein the strap comprises a first arm and a second arm, and coupling a rigid unit with the first arm and the second arm forming a closed loop. In some embodiments, the method further comprises attaching a logo to a front panel of the plurality of the panels. In other embodiments, the method further comprises attaching a rope located between the body and a visor. In some other embodiments, the rigid unit comprises a comb. In some embodiments, the comb comprises a surfing wax comb. In other embodiments, the rigid unit comprises a container. In some other embodiments, the method further comprises attaching a sweatband inside the body.

In another aspect, a cap comprises an elongated member hanging between a front panel and a visor and one or more objects having a hole on each of the objects allowing the elongated member going through the hole. In some embodiments, the elongated member comprises an elastic rope. In other embodiments, the elongated member comprises an s-hook and a hoop. In some other embodiments, the elongated member comprises an s-hook and a hoop at two terminal ends of the elongated member. In some embodiments, the one or more objects comprises a bead. In other embodiments, the bead comprises an alphabet or a graphic representation. In some other embodiments, the one or more objects forms a verbal expression.

In another aspect, an accessory carrying structure comprises detachable strap and an object with one or more apertures, wherein the detachable strap passes through the one or more apertures such that the object is immobilized. In some embodiments, the detachable strap couples with a hat. In some embodiments, the detachable strap couples with a bag.

DETAILED DESCRIPTION OF THE INVENTION

Figure 1C:
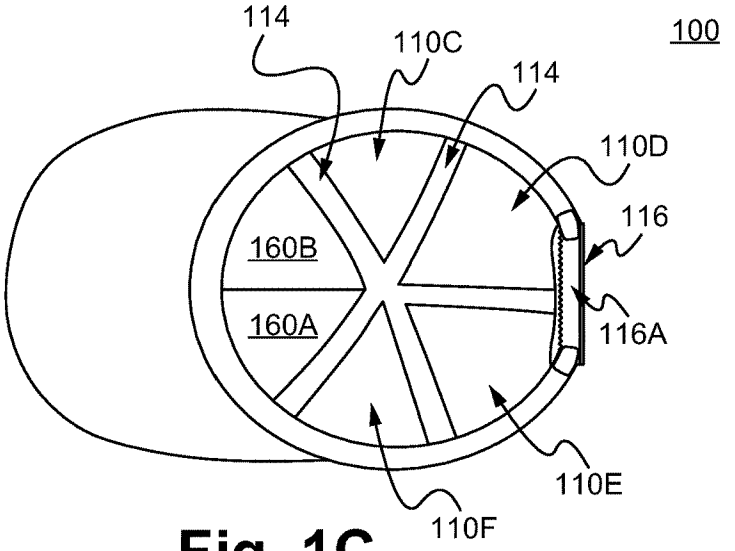
FIGS. 1A-1D illustrate various view of a cap 100 in accordance with some embodiments of the present invention.
Figure 1D:
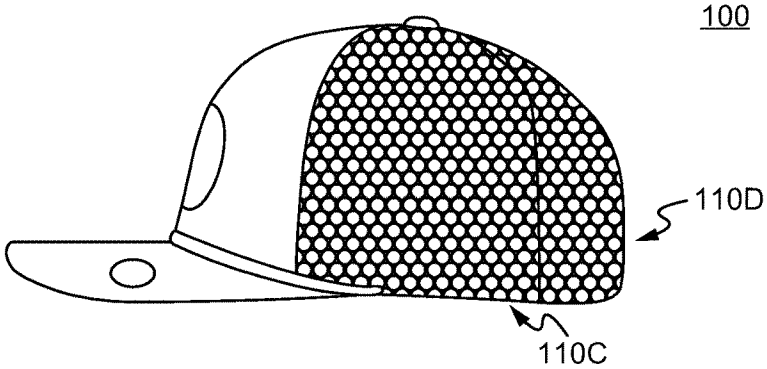
Figure 1A:
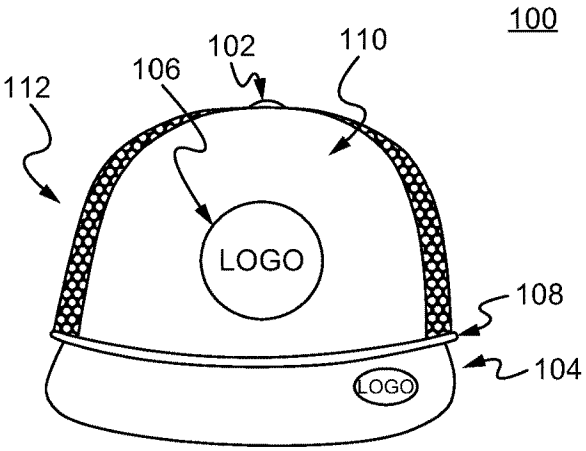
Figure 1B:
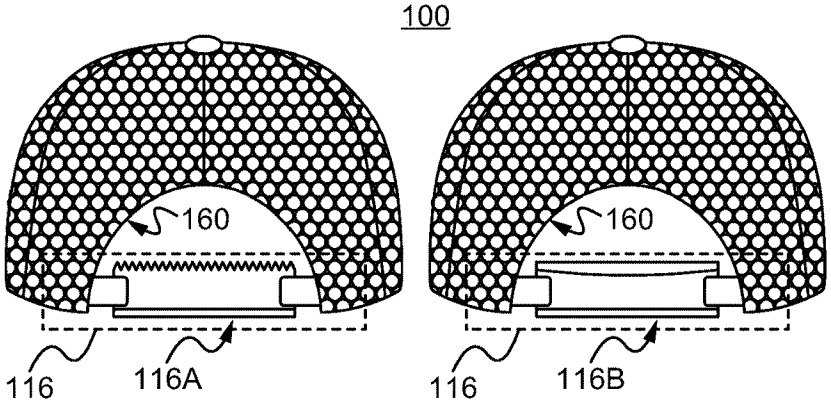

FIGS. 1A-1D illustrate various view of a cap 100 in accordance with some embodiments of the present invention. FIG. 1A shows a front view of the cap 100. FIG. 1B shows a back side vide of the cap 100. FIG. 1C shows a bottom side view of the cap 100. FIG. 1D shows a side view of the cap 100.

The cap 100 can comprise a bill 104, a body 112, and/or a top button 102. In some embodiments, the body 112 comprises one or more panels 110. In some embodiments, the body is formed by 6 panels 110A-110F. A person of ordinary skill in the art appreciates that any other numbers of panels are able to be used to form the body, such as 8, 9, or 20 panels in any shapes. In some embodiments, a front panel of the cap 110 is formed by two panels 110A and 11B. The side of the body is formed by four connected panels 110C-110F. In some embodiments, a logo 106 or a graphic pattern can be attached or printed on the front panels 110A and 110B.

In some embodiments, the cap 100 comprises a rope 108, such as a turquoise poly rope, snug fit between a connecting location of the bill 104 and the front panels 110A and 110B. In some embodiments, the rope is elastic band such that it can be used to constrain and/or immobile an object on the bill 104. In some embodiments, the rope 108 serves a visual effect of separating the bill 104 and the front panels 110A and 110B. In some embodiments, the button 102 comprises polyester foam. In some embodiments, the cap 100 comprises one or more eyelets. In some embodiments, the cap 100 comprises a sweatband formed by cotton, which can be 100% cotton in some embodiments.

In some embodiments, the front panel is formed by polyester foam, which can be 100% polyester or a mixture of materials, such as 90% polyester and 10% of cotton. A person of ordinary skill in the art would appreciate that any other materials and compositions are able to be used to form the front panel. In some embodiments, the panels 110A and 11B are joined by stitches having same or different colors of the panels 110A and 110B. In some embodiments, the side panels (110C, 110F) and the back panels (110D, 110E) comprise mesh structure, which can be made by 100% nylon. A person of ordinary skill in the art will appreciate that the panels can comprise a solid body, mesh, or a combination thereof.

In some embodiments, the top side and the bottom side of the bill/visor 104 are made of polyester foam. In some other embodiments, different materials are able to be used to make the top side and the bottom sides respectively. In some embodiments, the bill 104 comprise a square flat visor. In some embodiments, one or more inside crown tapes 114 are attached/coupled at the seams joining the panels 110A-110F.

In some embodiments, the cap 100 comprises a strap 116. The strap 116 is able to attach to a functional unit 116A, such as a surfing wax comb.

Figure 2D:
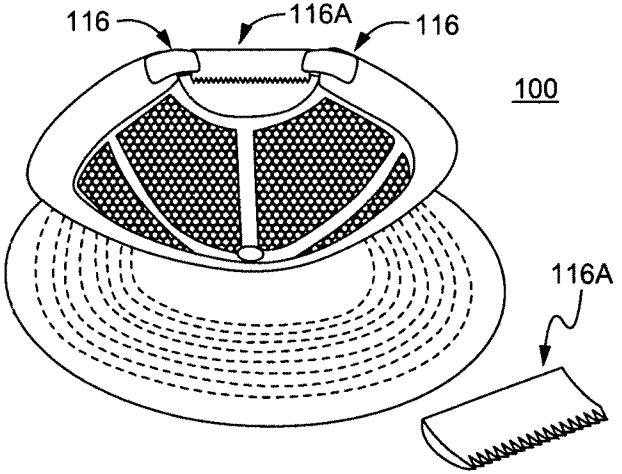
FIGS. 2A-2E illustrate a construction 200 of the strap 106 of the cap 100 in accordance with some embodiments of the present invention.
Figure 2E:
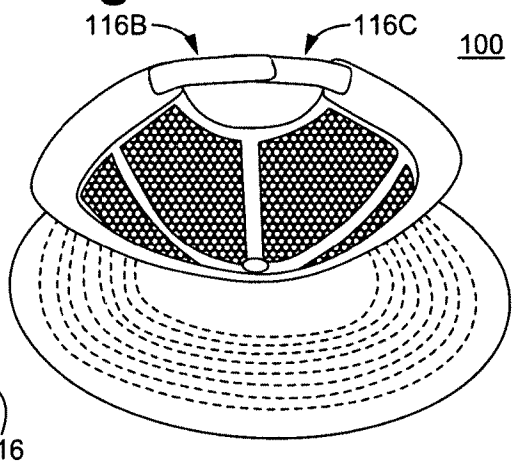
Figure 2C:
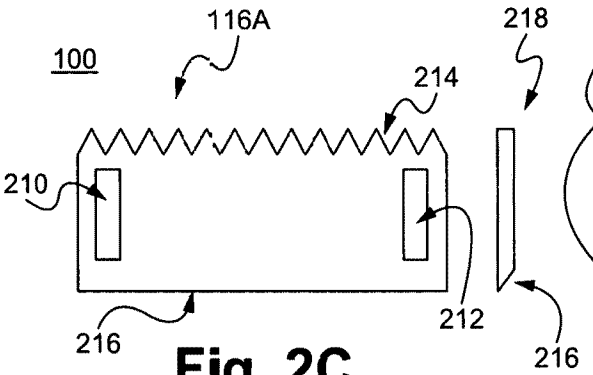
Figure 2A:
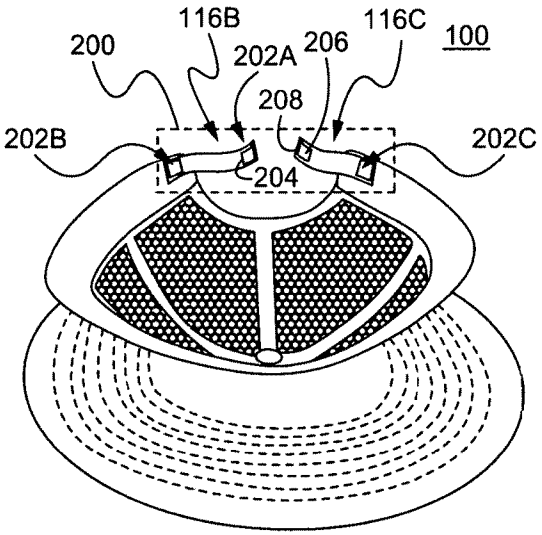
Figure 2B:
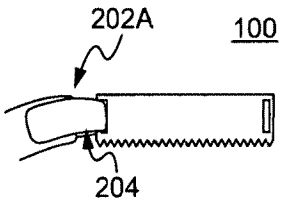

FIGS. 2A-2E illustrate a construction 200 of the strap 106 of the cap 100 (FIG. 1A-1D) in accordance with some embodiments of the present invention. All the figures disclosed here can be read together and the number references are able to be applied throughout the present specification. As shown in FIG. 2A, the strap 116 comprises a left strap portion 116B and right strap portion 116C.

In some embodiments, the strap 116 comprises one or more Velcro® pieces (hook and loop structure) as a securing member. In some embodiments, the left strap portion 116B comprises a female Velcro® portion 202B (e.g., loop structure) on the insider 204 of the left strap 116B. Near the end of the left strap 116B, a male Velcro® portion 202A is attached.

In some embodiments, the right strap portion 116C comprises a male Velcro® portion at the outside portion 208 of the right strap portion 116C and a female Velcro® portion in the inside portion 206 of the right strap portion 116C.

In some embodiments, a functional element 116A can be coupled with the strap 116. The left strap portion 116E can go through the opening 212 (FIG. 2C) and folding back to secure a first end (FIG. 2B), thereby the inside 204 of the left strap 116B is attached with the male Velcro® portion 202B. The right strap portion 116C is able to be secured to a second end going through the opening 210 (FIG. 2C) via the hook-and-look structure of the Velcro® on the right strap portion 116C, thereby the inside portion 206 can be coupled with the male Velcro® 202C. FIG. 2D shows that the functional element 116A is secured on the strap 116. A person of ordinary of skill in the art would appreciate that the male and female Velcro® can be located in any locations and with any numbers on the strap 116 so long as it can provide a securing coupling function.

The functional unit 116A can be a surfing wax comb, an empty container 116B, a lip stick bar, a package of energy bar, a key holder, and a securing structure for securing cell phone or any other electronic devices. A person of ordinary skill in the art would appreciate that the functional unit 116A can be any functional or decorative pieces.

FIG. 2E shows that the left strap portion 116B is coupled with the right strap portion 116C without attaching the functional unit 116A. In this example, the inside portion 204 of the left strap 116B is coupled with the outside portion 208 of the right side strap via the hook-and-loop structure of the Velcro®. A person of ordinary skill in the art appreciates that any other securing mechanisms are able to be used. For example, Velcro® male and female structures can be in zones alternatively placed on a surface.

FIG. 2C shows a construction of the functional unit 116A in accordance with some embodiments of the present invention. In some embodiments, the functional unit 116A comprises an elongated body having a first opening 210 and a second opening 212 at each side of the unit 116A. In some embodiments, the openings 210 and 212 have a size 0.18 inch×0.75 inch. In some embodiments, the body has a size of 3.25 inch in its length and 1.40 inch in its height. A teeth edge structure 214 can be on the top of the body. The bottom side of the unit 116 can comprise a beveled edge 216. A side view 218 of the unit 116A is also shown.

Figure 3:
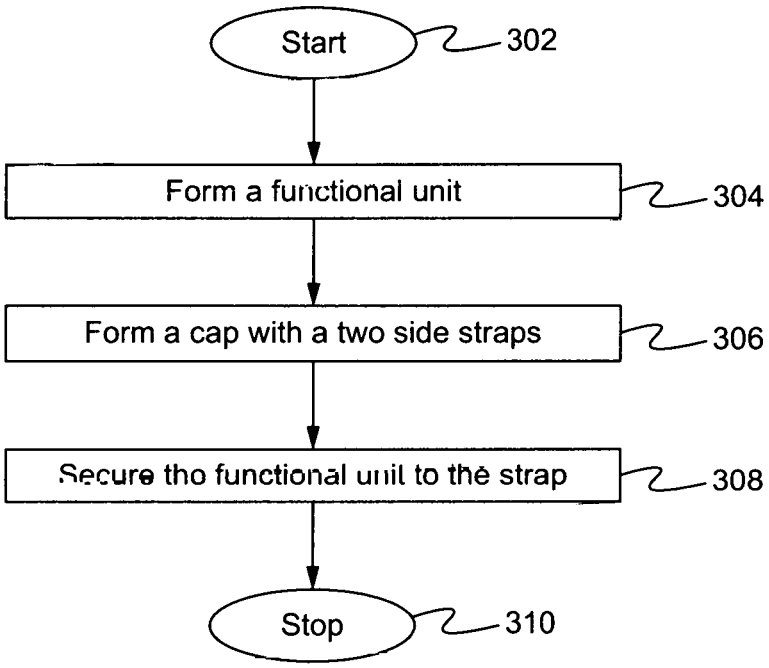
FIG. 3 illustrate a method of making a baseball cap in accordance with some embodiments of the present invention.

FIG. 3 illustrate a method of making a baseball cap in accordance with some embodiments of the present invention. The method 300 can begin at a Step 302. At a Step 304, a functional unit is selected to be formed. For example, when a client is requesting a cap for beach use. A manufacturer is able to select a container to be manufactured for containing an amount of sun screen lotion. At a Step 306, a cap with two side straps are formed. At a Step 308, the functional unit is secured to the strap. The method 300 can stop at a Step 310.

FIGS. 4A-4E illustrate a baseball cap attachment piece 400 and its uses in accordance with some embodiments of the present invention.

Figure 4A:
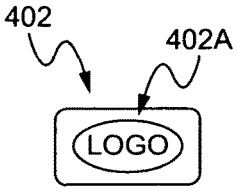
FIGS. 4A-4E illustrate a baseball cap attachment 400 and its uses in accordance with some embodiments of the present invention.

FIG. 4A shows a front view of the attachment piece 402. The attachment piece 402 is able to contain a logo piece 402A. The logo piece 402 is able to be printed, sew (e.g., embroider fabrics with color or plain threads) or attached on as a separate piece (e.g., an attachable sticker.)

Figure 4B:
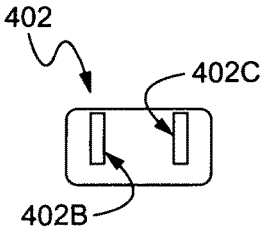

FIG. 4B shows the back side view of the attachment piece 402. The attachment piece 402 comprises one or more extending members 402B and 402C. In some embodiments, the extending members 402B and 402C comprises elongated structures, such as legs. In some embodiments, the extending members 402B and 402C are elastic, thus providing a force against a body of the attachment piece 402 to be able to clip on an object, such the hack strap of a cap.

Figure 4C:
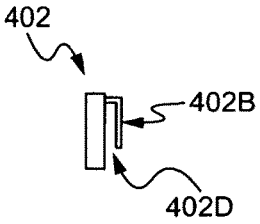

FIG. 4C is a side view of the attachment piece 402. In some embodiments, the attachment piece 402 comprises a gap/slot 402D allowing an object to go through, such as a piece of fabric, allowing the attachment piece 402 to be attached on the object via its "L" shape structure.

Figure 4D:
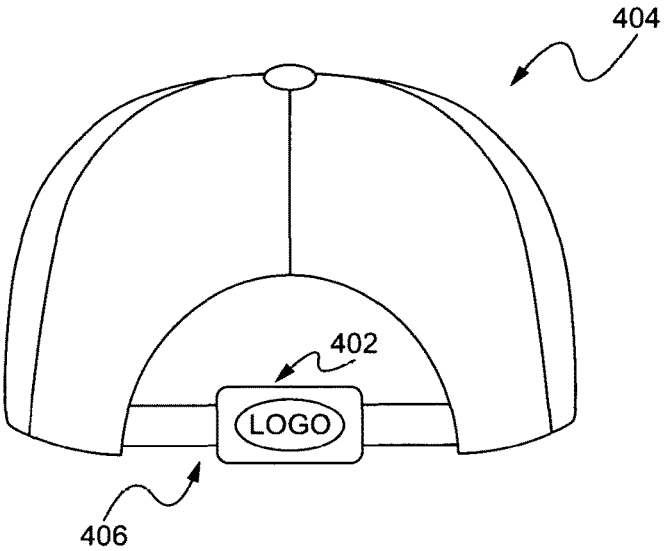
Figure 4E:
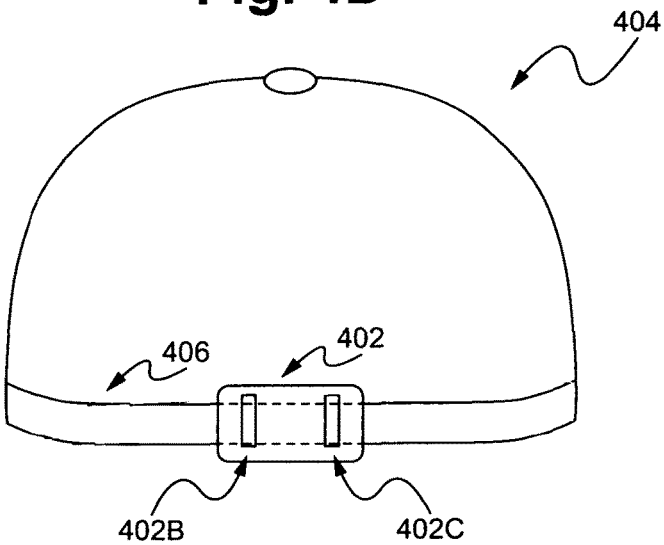

FIG. 4D is a back side view of a cap 404 illustrating a use of the attachment piece 402 on a strap 406 of the cap 404. In some embodiments, the attachment piece 402 is able to be attached to any typical cap as an added on FIG. 4E is a front cross sectional view of the cap 404. The attachment piece 402 is able to be attached to a back strap 406 by having the strap 406 going through the extending members 402B and 402C.

Figure 5:
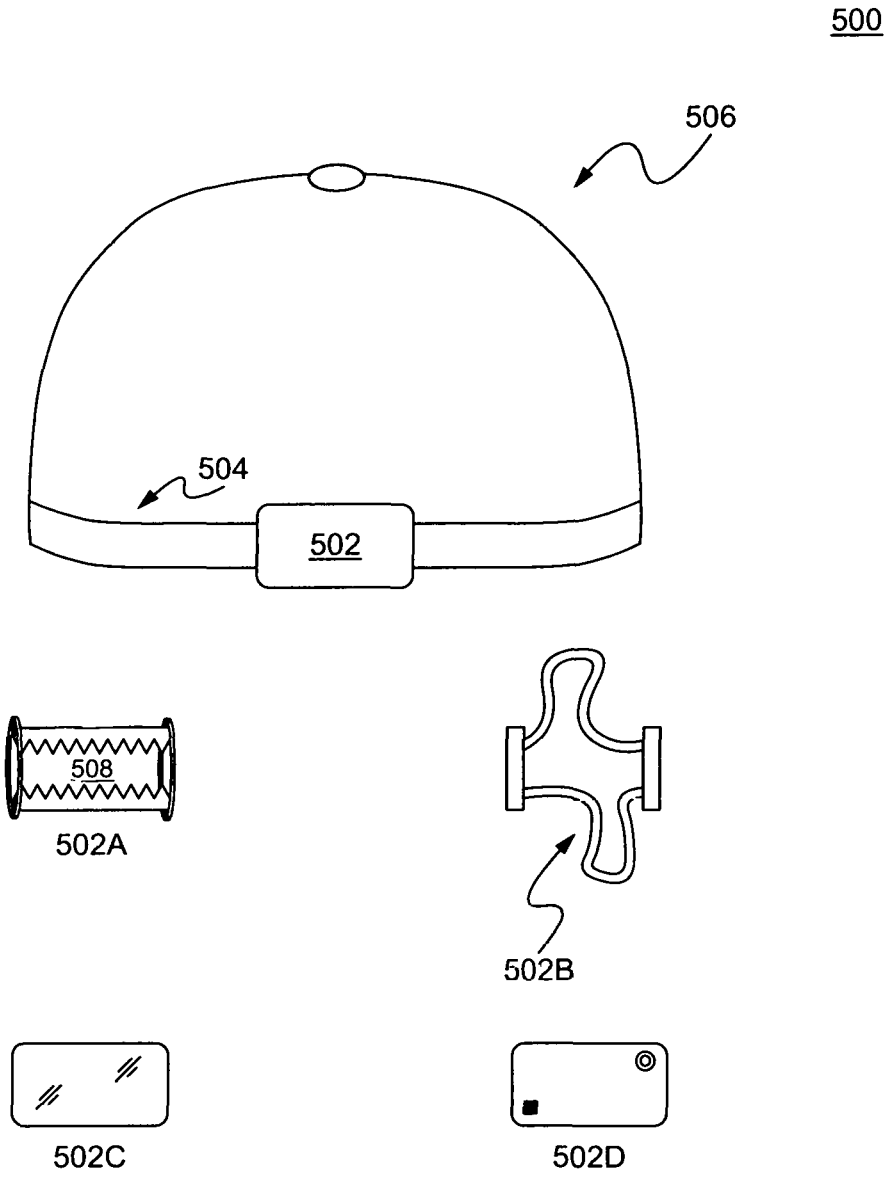
FIG. 5 illustrates some selected embodiments 500 of the attachment piece 402 (FIG. 4) and/or functional unit 116A (FIG. 1) in accordance with some embodiments of the present invention.

FIG. 5 illustrates some selected embodiments 500 of the attachment piece 402 (FIG. 4) and/or functional unit 116A (FIG. 1) in accordance with some embodiments of the present invention. In some embodiments, a cap 506 comprises a unit 502 on a strap 504. In some embodiments, the unit 502 is designed to be located at back of a cap. In some other embodiments, the unit 502 is designed to be located at front of the cap or in any predetermined location on the cap. The unit 502 can comprises a polymeric material (such as, silicone, polyethylene (PE), PVC, polypolyene (PP), and any other polymeric materials), a fabric, a paper/pulp based material, and/or a metal/alloy based material.

In some embodiments, the unit 502 comprises a hair fastening device 502A having two rigid plastic pieces with teeth for confining hairs through the hole 508. The opening of the hole 508 is able to be adjusted by the elastic bands (such as rubber bands) at two sides. In some other embodiments, the unit 502 comprises a hair band 502B having two rubber bands that can be used to confine hairs. In some other embodiments, the unit 502 can comprise a mirror 502C or an electronic device, such as a camera and/or a speaker 502D. The camera and/or speaker 502D is able to be coupled with a smart phone, a server, or a computer via wifi, GSM, or Bluetooth or any other wired or wireless communication methods.

The functional unit can be secured on the strap using various methods or structures. For example, a detachable and re-attachable glue (such as a pressure sensitive adhesive, PSA) or polymer is able to be used on the strap for securing the functional unit.

Figure 6:
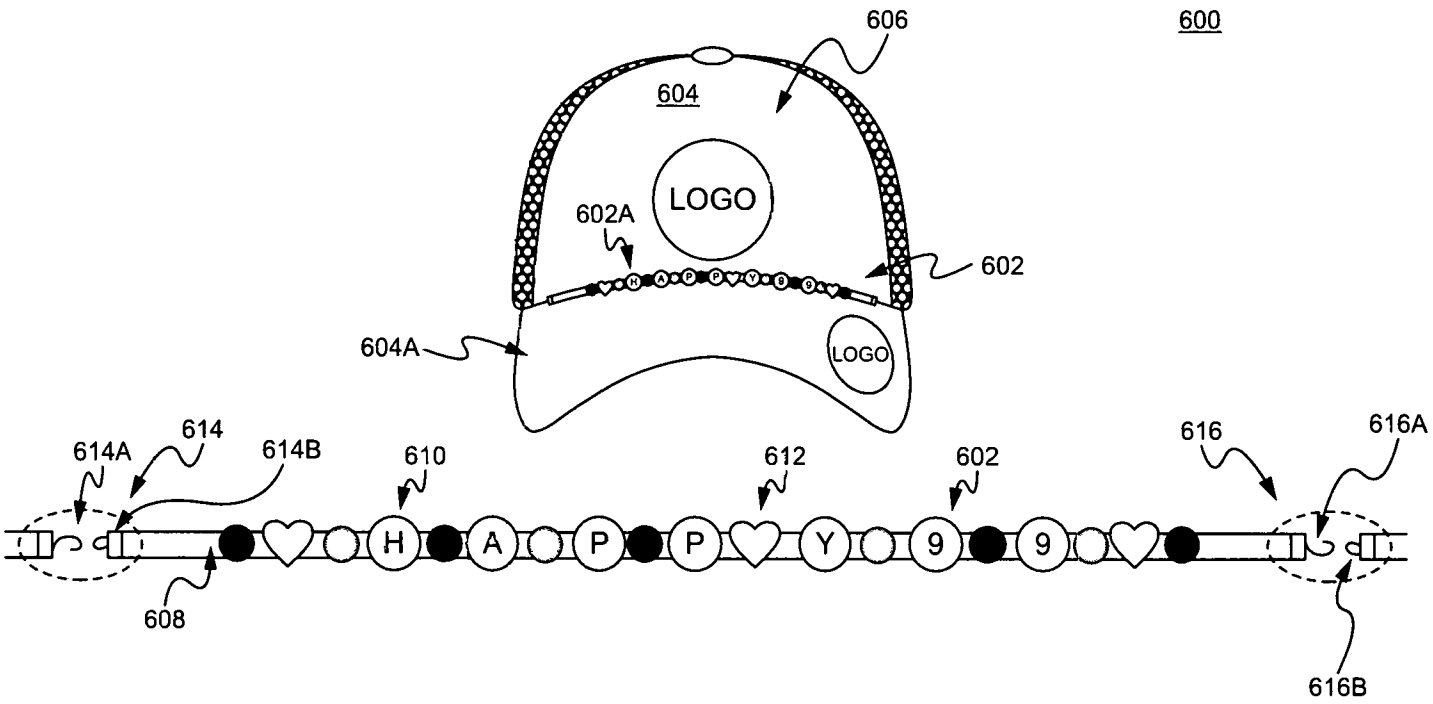
FIG. 6 illustrates a cap 600 with a strip in accordance with some embodiments of the present invention.

FIG. 6 illustrates a cap 600 with a strip 602 in accordance with some embodiments of the present invention. In some embodiments, the strip 602 is located between the connecting seam of a front panel 604 and a visor 604A. In other embodiments, the strip 602 is at the front panel 604, such as hanging on the front panel 604. In some other embodiments, the strip 602 is placed on the front visor 604A. A person of ordinary skill in the art would appreciate that the strip 602 is able to be at any location coupled with the cap 600. Further, a person of ordinary skill in the art would appreciate that any number of strips are able to be on the cap 600, such as 1, 2, 3, 5, 10, and 20.

In some embodiments, the strip 602 is a functional strip providing expression decorative objects 602A. The expression decorative objects 602A is able to be beads with one or more alphabets and/or any decorative bodies, such as an alphabet bead 610 and a heart shape object 612. In some embodiments, the expression decorative objects 602A comprises one or more 7 mm text plastic beads and 5 mm or 7 mm plastic/ceramic heart shape beads. In some embodiments, an order or arrangement of the expression decorative objects 602A form an expression, such as a logo, a brand, and/or a word, such as "FANTASTIC!"

In some embodiments, the strip 602 comprises structures 614 and 616 providing an instant attachable/detachable or quick hook member, such as an s-hook 614A and a hoop 614B. The s-hook 614A is able to hook on hoop 614B. Similarly, an s-hook 616A is able to be coupled with a hoop 616B. The structure 614 is able to be at the left side of the cap and the structure 616 is able to be at the right side of the cap. A person of ordinary skill in the art would appreciate that any other quick hook structures or fixed structure (such as, glued on rope) are within the scope of the present invention.

In some embodiments, the strip 602 comprises a body 608, which can be a rope (e.g., a 3 mm faux suede rope) or a metal chain (e.g., a silver chain). In some embodiments, the strip 602 comprises a removable charm bracelet made of 3 mm faux suede rope having a silver s-hook closure at side seams of the front panel 604.

In some embodiments, the front panel comprises a graphic pattern 606, which can be flat embroidery. A person of ordinary skill in the art would appreciate that any decorative and/or functional objects are able to be added on to the strip 602.

Figure 7A:
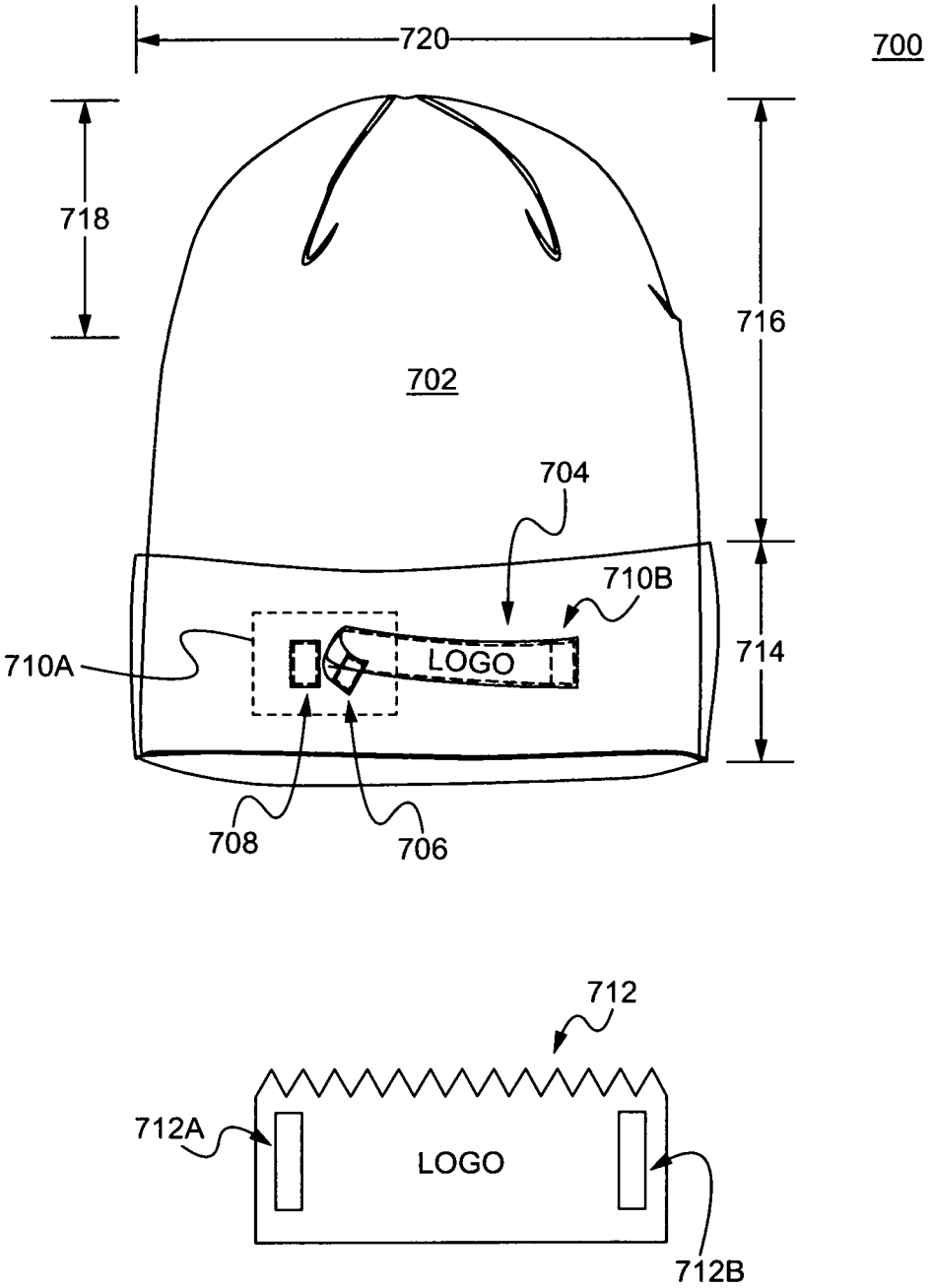
FIGS. 7A and 7B illustrate a beanie hat 700 with a wax comb 712 in accordance with some embodiments of the present invention.

FIG. 7A illustrates a beanie hat 700 with a wax comb 712 in accordance with some embodiments of the present invention. In some embodiments, the hat 700 comprises a body 702. A tag 704 couples at a folding portion 714 of the body 702. The body 704 comprises a left coupling structure 710A and right coupling structure 710B. The coupling structure 710A and 710B can comprise one or more Velcro® having a loop portion 708 immobilized onto the body 702 and a hook portion 706 immobilized onto the tag 704. A person of ordinary skill in the art would appreciate that the hook portion 706 is able to be fixed onto the body 702 and the loop portion 708 is able to be fixed onto the tag 704.

The loop portion 708 and the hook portion 706 forms an instant attachable/detachable mechanism by having the hooks on the hook portion 706 engaging the loops on the loop portion 708. Each of the coupling structures 710A and 710B can have one or more pairs of the hook and loop coupling mechanisms. In some embodiments, the tag 704 can be formed by a flexible cloth or polymeric substance.

In some embodiments, the wax comb 712 is able to be coupled with the tag 704. For example, the left coupling structure 710A of the tag 704 is able to be detached and passing through the holes 712B and 712A. After the tag 704 going through both holes 712A and 712B, the tag 704 is attached back to the body 702, such that the wax comb 704 is immobilized on the hat 700. In some embodiments, the tag 704 is detachable at one side and permanently fixed at the other side.

In some embodiments, the hat 700 has a diameter 720 from 8 inch to 10 inch, wherein a dome portion 718 at the top of the hat 700 has a height about 3-5 inches. In some embodiments, the tag 704 comprises a strap having a length of 4.25 inch and a width of 0.75 inch. The loop portion 708 and a hook portion 706 can comprises a piece of Velcro having a size of 0.75 inch by 0.5 inch. In some embodiments, the wax comb has a length 3.25 inch and a width 1.4 inch with a teeth having a height of 0.25 Inch. The holes 712A and 712B can be 0.75 inch by 0.1875 inch.

Figure 7B:
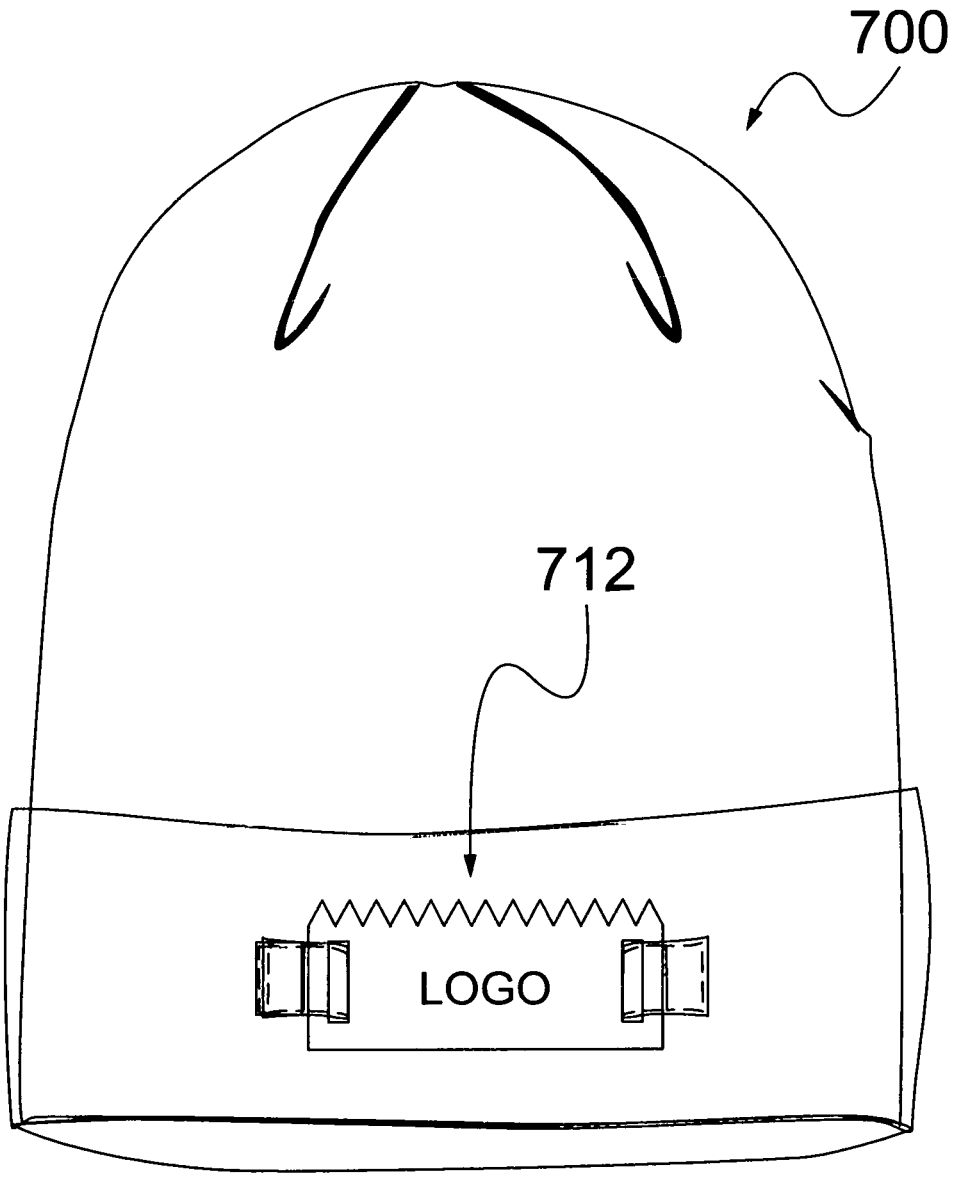

FIG. 7B illustrates the beanie hat 700 coupled with the wax comb 712 in accordance with some embodiments of the present invention.

Figure 8:
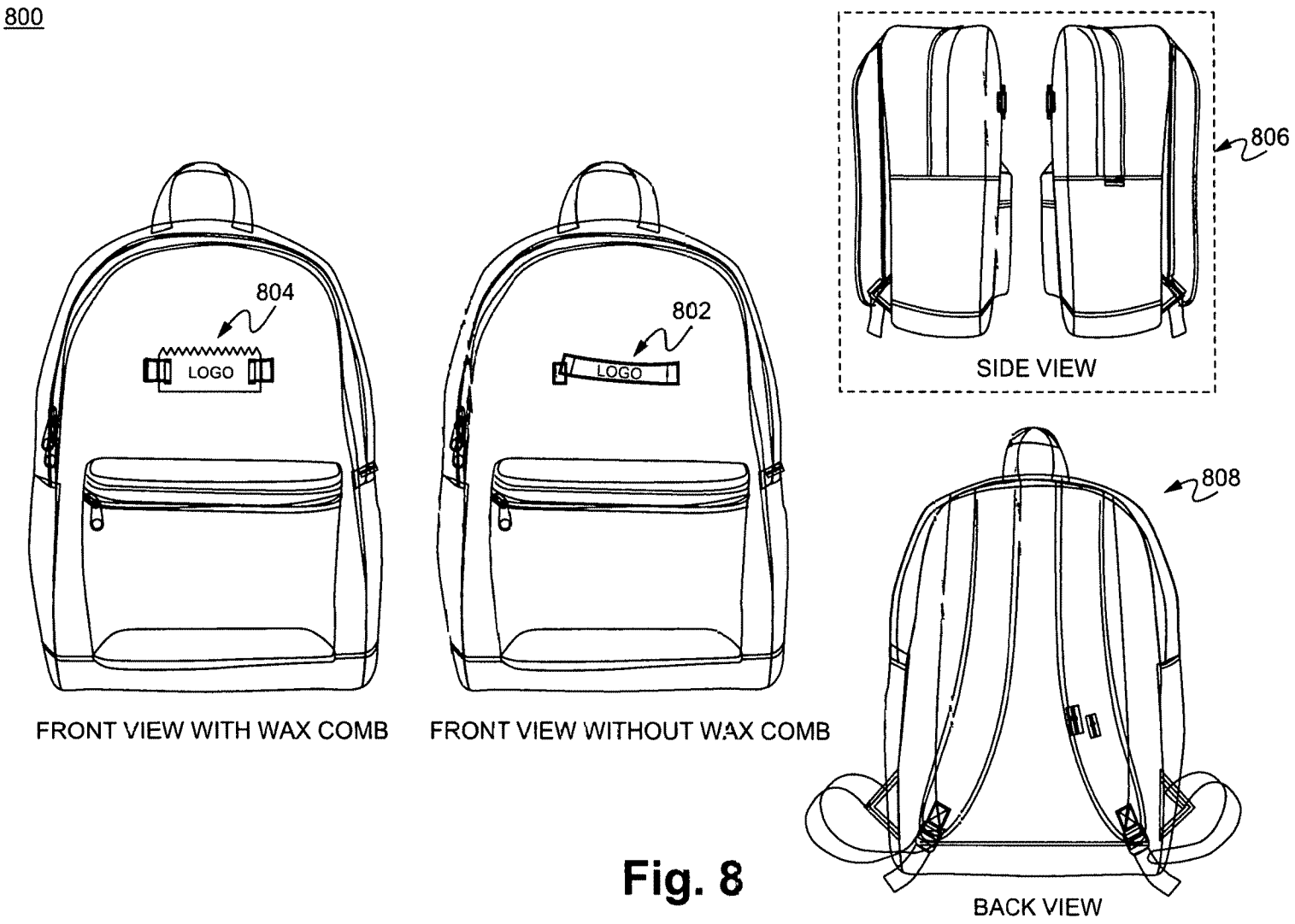
FIG. 8 illustrates a bag 800 coupled with the wax comb 804 in accordance with some embodiments of the present invention.

FIG. 8 illustrates a bag 800 coupled with the wax comb 804 in accordance with some embodiments of the present invention. Similar to the wax comb immobilizing structure described above, the bag 800 is able to have a tag 802, which is able to be used to couple with a wax comb 804. Side views 806 and the back view 808 of the bag 800 are also shown.

In utilization, a functional unit is able to be used as a container or a tool for a predetermined function.

In operation, a functional unit is able to be coupled with two sides of a strap to be secured on the strap.

The description is presented to enable one of ordinary skill in the art to make and use the invention. Various modifications to the described embodiments are readily apparent to those persons skilled in the art and the generic principles herein can be applied to other embodiments. Thus, the present invention is not intended to be limited to the embodiments shown but is to be accorded the widest scope consistent with the principles and features described herein. It is readily apparent to one skilled in the art that other modifications can be made to the embodiments without departing from the spirit and scope of the invention as defined by the appended claims.

What is claimed is:

1. A cap comprising:

a) a body of the cap;

b) a strap having an extendable structure for adjusting a size of the cap, wherein the strap comprises a first elongated member and a second elongated member;

c) a wax comb as a connecting member between the first elongated member and the second elongated member, the wax comb having a teeth edge structure located at a top side, a beveled edge located at a bottom side, a first opening located at a left side and a second opening located at a right side of the wax comb, wherein the first opening and the second opening are configured to couple with the first elongated member and the second elongated member, wherein the first elongate member goes through the first opening forming a first loop when the first elongated member couples with the wax comb and the first elongated member and the second elongated member are configured to couple with each other when without the wax comb.

2. The cap of claim 1, wherein the first elongate member comprises a female structure attachable to a male structure at an end of the first elongated member.

3. The cap of claim 2, wherein the male structure comprises a structure having a specific engaging force with the female structure.

4. The cap of claim 1, wherein the connecting member comprises a rigid polymeric object.

5. A baseball cap comprising:

a) one or more panels forming a body of the baseball cap;

b) a strap having a first connecting member and a second connecting member; and c) a wax comb having a body with a teeth edge structure located at a top side, a beveled edge located at a bottom side, and a first opening located at a left side and a second opening located at a right side, wherein the first opening and the second opening are configured to couple with the first connecting member and the second connecting member to form a closed circle for fitting a head of a user, wherein the first connecting member goes through the first opening forming a first loop when the first connecting member couples with the wax comb and the first connecting member and the second connecting member are configured to couple with each other when without the wax comb.

6. The baseball cap of claim 5, wherein the body comprises a rope between the body and a visor.

7. The baseball cap of claim 5, wherein the body comprises a logo at a front panel of the body.

8. The baseball cap of claim 5, wherein the body comprises one or more mesh structures.

9. The baseball cap of claim 5, wherein the body comprises a front panel having a solid structure.

* * * * *